US006238254B1

(12) United States Patent
De Pourquoy et al.

(10) Patent No.: US 6,238,254 B1
(45) Date of Patent: May 29, 2001

(54) HOUSING FOR AN ELECTRICAL APPARATUS

(75) Inventors: Laurent De Pourquoy, Grenoble (FR); Tim Faber, Marion, IA (US)

(73) Assignee: Schneider Electric, SA (FR)

( * ) Notice: Subject to any disclaimer, the term of this patent is extended or adjusted under 35 U.S.C. 154(b) by 0 days.

(21) Appl. No.: 09/166,083

(22) Filed: Oct. 5, 1998

(30) Foreign Application Priority Data

Oct. 8, 1997 (FR) ..... 97 12780

(51) Int. Cl.[7] ..... H01R 4/36
(52) U.S. Cl. ..... 439/813; 361/634
(58) Field of Search ..... 439/813; 361/611, 361/624, 634, 637, 673; 200/51 R

(56) References Cited

U.S. PATENT DOCUMENTS

| | | | | |
|---|---|---|---|---|
| 2,795,766 | | 6/1957 | Dyer et al. | 339/64 |
| 3,748,420 | | 7/1973 | Rexroad | 200/168 R |
| 4,144,554 | * | 3/1979 | Erickson | 200/637 |
| 4,288,656 | * | 9/1981 | Olashaw | 361/637 |
| 4,307,359 | | 12/1981 | Schultz et al. | 335/23 |
| 4,825,338 | * | 4/1989 | Hubbard et al. | 200/51 R |
| 4,836,808 | * | 6/1989 | Mallet et al. | 439/813 |
| 4,905,122 | * | 2/1990 | Culnan et al. | 439/813 |
| 5,292,264 | * | 3/1994 | Blank | 439/813 |
| 5,847,939 | * | 12/1998 | Cotton | 361/673 |
| 5,995,362 | * | 11/1999 | Morel et al. | 367/624 |

FOREIGN PATENT DOCUMENTS

| | | |
|---|---|---|
| 295 13813 U1 | 2/1997 | (DE) . |
| 0 555 157 A1 | 8/1993 | (EP) . |
| 2 535 534 A1 | 5/1984 | (FR) . |

* cited by examiner

*Primary Examiner*—Renee Luebke
*Assistant Examiner*—Ann McCamey
(74) *Attorney, Agent, or Firm*—Parkhurst & Wendel, LLP

(57) ABSTRACT

The present invention relates to a case designed for housing an electrical apparatus such as a circuit breaker.

This case includes terminal compartments for housing connection strips and component(s) for fixing the strips to external conductors, such as a bar, a cable etc., respectively.

The fixing components include for at least one of the compartments, a first opening provided in the case and a second opening provided in the connection strip and situated facing the first opening(s), and at least one screw passing through two orifices facing one another and provided, respectively, in the case and in the strip to perform fixing of a conductor onto the connection strip, the first opening is shaped in such a way as to receive and guide in rotation at least one screw head of a circular shape, and block in rotation with respect to the case at least one screw head of a non-circular shape.

9 Claims, 7 Drawing Sheets

HOUSING FOR AN ELECTRICAL APPARATUS

BACKGROUND OF THE INVENTION

The present invention relates to a case designed for housing an electrical apparatus such as a circuit breaker, which includes at least at one of its ends, terminal compartments in which there are respectively housed connection strips and means for fixing the strips to external conductors such as a bar, a cable etc.

Different possibilities currently exist for power connection of a low voltage circuit breaker via the front of the apparatus. Connection to cables by means of terminals, connection to bars or connection of the "disconnectable" type to a fixed rigid conductor are in fact known.

Generally, switching from one connection mode to another requires the use of different parts. For example, for fixing a connection strip to a bar, the screws have to be immobilized in rotation. One of the solutions presently used consists of fitting the screws in metallic clips or small insulating plates fixed in removable manner to the connection strips. After the bars have been mounted on the screws, the latter are secured on the connection strips by nuts. On the other hand, for connection to power cables, immobilization of the screws in this way is not necessary. The latter are fitted across the strips via the rear of the apparatus and screwed directly into the terminals fitted for this purpose on the connection strips. According to these embodiments, the isolation distances are ensured either by a cover screwed under the apparatus (in the case of use of a clip) or by a suitable shape and dimensions of the previously mentioned plate, when the latter is used.

SUMMARY OF THE INVENTION

The present invention proposes a case for an electrical apparatus of simple design enabling different types of connection to be achieved using a minimum number of parts.

For this purpose, the object of the present invention is to devise a case of the type mentioned above which includes a device for fixing the strips to the conductors includes, for at least one of the previously mentioned compartments, at least a first opening provided in the case, at least a second opening provided in the connection strip and situated facing the first opening(s), and at least one screw passing through two orifices facing one another and provided respectively in the case and in the strip to fix a conductor onto the connection strip. The first opening is shaped in such a way as, on the one hand to receive and guide in rotation at least one screw head of circular shape and, on the other hand, to block in rotation with respect to the case at least one screw head of a suitable non-circular shape.

According to a particular feature of the invention, the screws with circular heads are designed for fixing terminals onto the connection strip.

According to a particular feature of the invention, the previously mentioned screws with non-circular heads are designed for fixing the bars onto the connection strips.

According to another feature, the or each first opening is also designed to receive a fixed rigid conductor.

According to another feature, the or each first opening forms at least one housing of appreciably hexagonal shape cooperating with at least one screw whose head is appreciably of the same shape.

BRIEF DESCRIPTION OF THE DRAWINGS

Other advantages and features of the invention will become more clearly apparent from the following detailed description which refers to the accompanying drawings given for example purposes only and in which.

DETAILED DESCRIPTION OF THE PREFERRED EMBODIMENT

Figure 1:
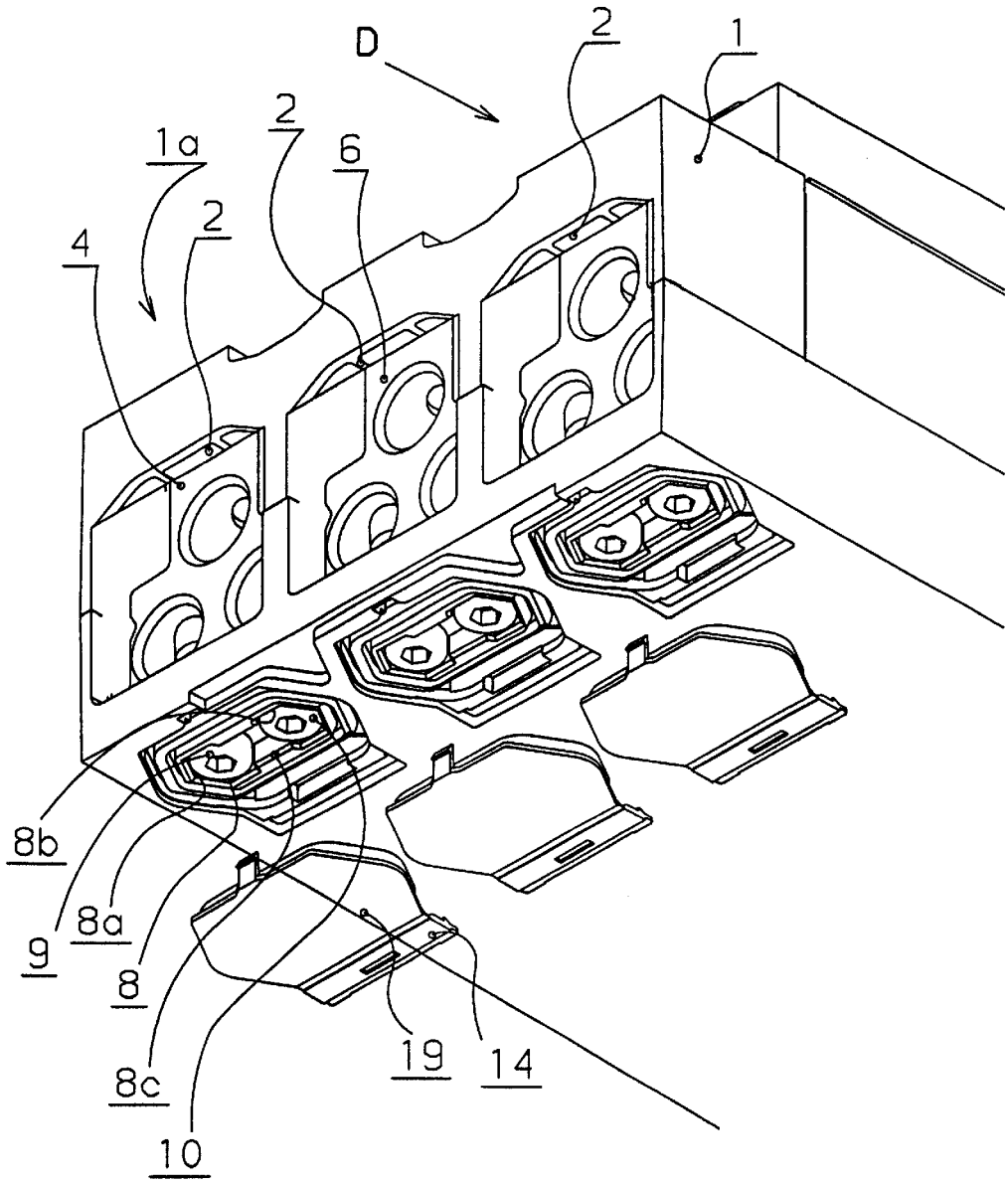
FIG. 1 is a partial perspective view, illustrating the rear part of a low voltage circuit breaker housed in a case according to the invention and in which the "terminal" type connection mode is used.

In FIG. 1, a low voltage power circuit breaker D can be seen housed in a molded insulating case 1, the case 1 including at one of its ends 1*a* (the only one which can be seen in this Figure), compartments 2 in which the connection strips 3 of the switchgear apparatus extend.

Figure 2:
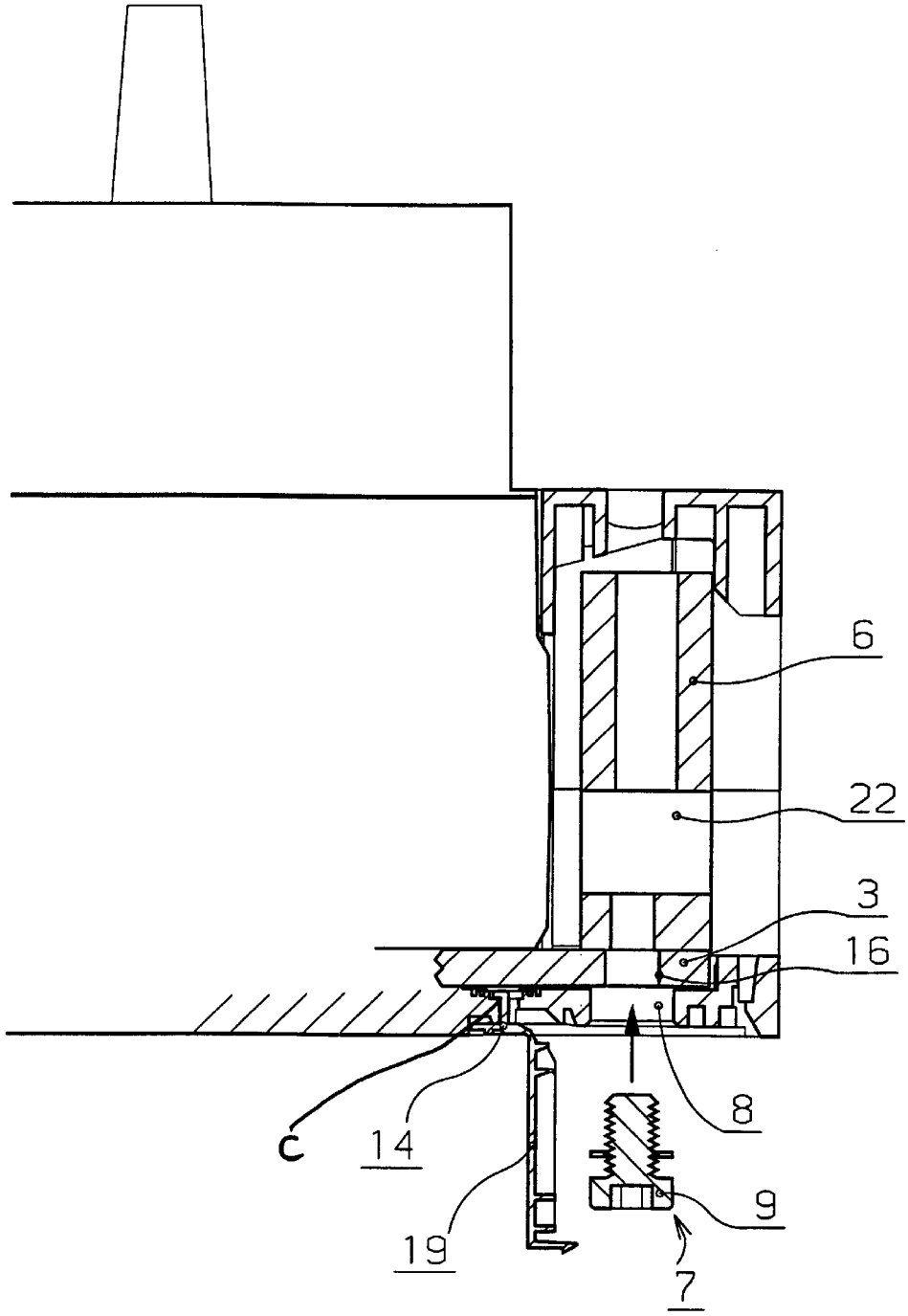
FIGS. 2 and 3 are partial longitudinal sectional views of FIG. 1, in the non-connected and connected position of the cable, respectivelly
Figure 3:
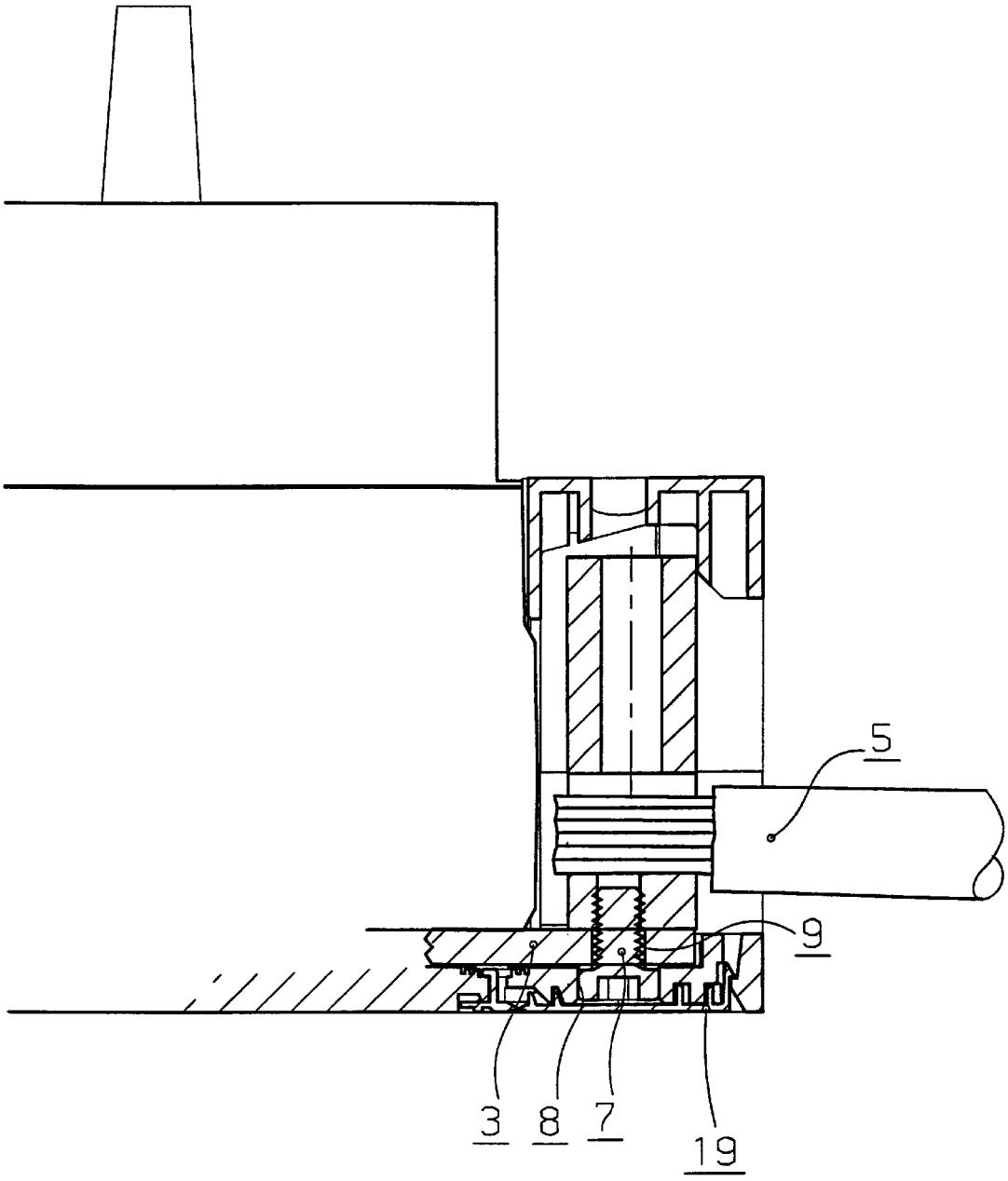

According to the embodiment illustrated in FIGS. 1 to 3, the compartments 2 are designed to house terminals 4 for connection to the previously mentioned strips 3 to power cables 5. These terminals 4 are formed of blocks 6 fixed onto the strips 3 by bolts or screws 7 inserted via the rear of the case 1, through first and second openings 8, 16 provided in the case 1 and in the corresponding strip 3, respectively before being screwed into one of the ends of the corresponding terminal 4.

As can be seen more particularly in FIG. 1, each compartment 2 of the case 1 has associated thereto an opening 8, called the first opening, arranged in the rear part of the case 1 and enabling the passage of two fixing screws of a terminal 4. This opening 8 forms two housings 8*a*, 8*b* of appreciably hexagonal shape, joined by a straight part 8*c*.

The housings 8*a*, 8*b* are shaped in such a way as to allow each housing to receive and allow free rotation of a screw with a hollow-cast round head 9, 10 used for fixing a terminal 4.

Figure 4:
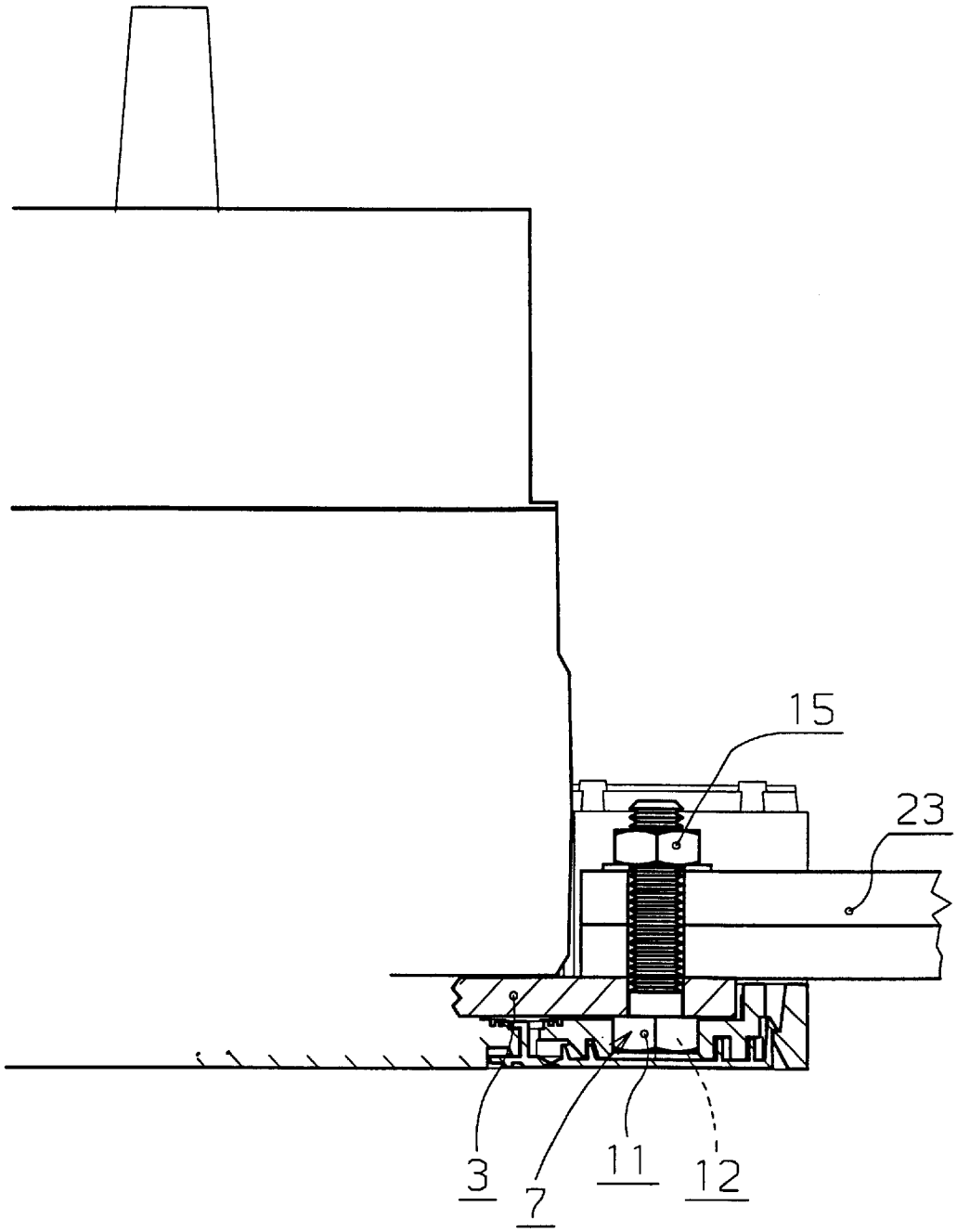
FIG. 4 is a sectional view similar to FIGS. 2 and 3, illustrating the bar type connection mode.

In FIG. 4, it can be seen that the connection strips 3 are each connected to a bar 23. In this case, the fixing screws of the bars 23 need to be immobilized in rotation. For this purpose, screws are used presenting a hexagonal head 11, 12, which, when inserted in the openings 8, are immobilized in rotation by the walls forming the limits of the portions of openings 8*a*, 8*b* of hexagonal shape.

Figure 5:
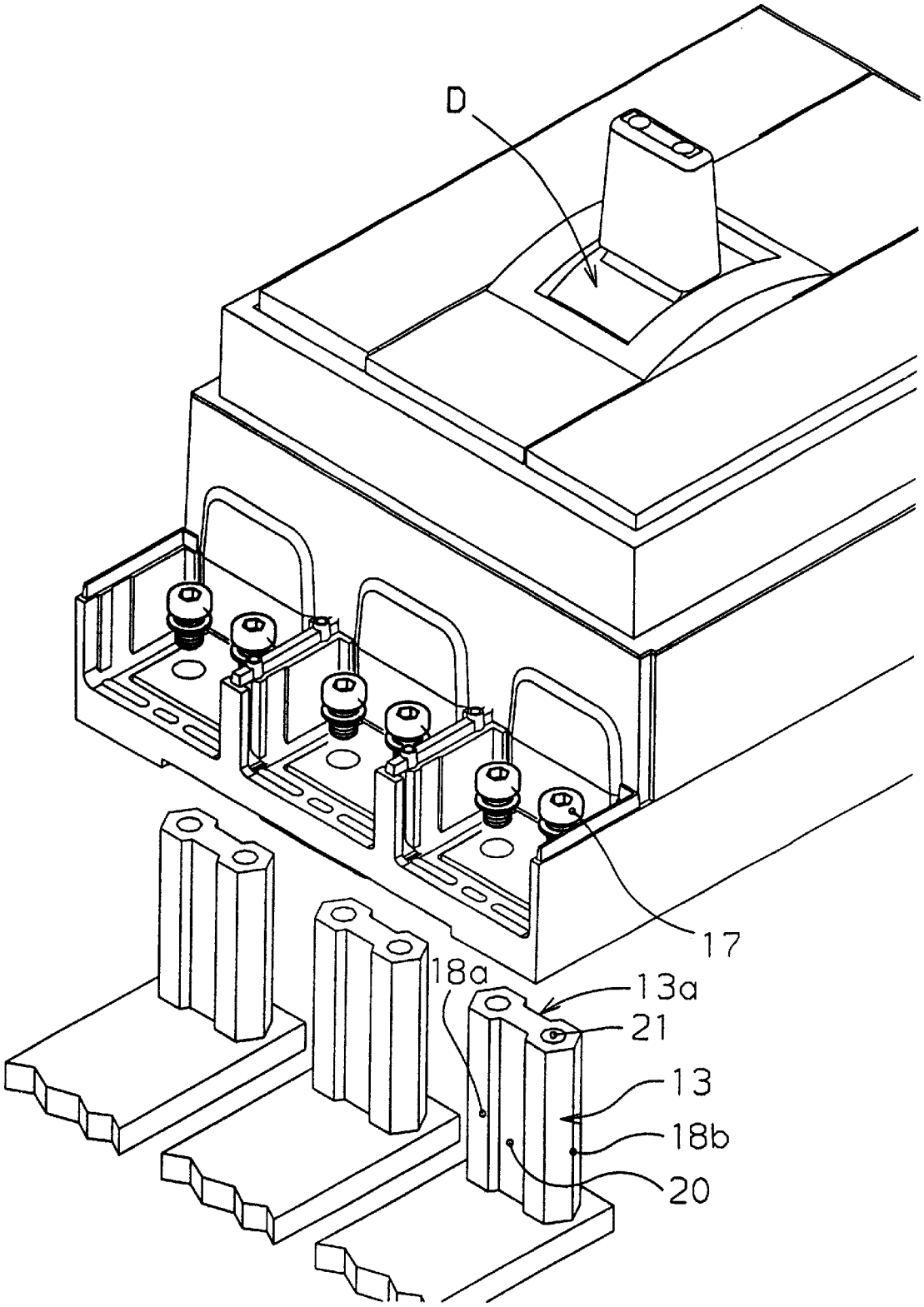
FIG. 5 is a partial perspective view, illustrating the front part of the case of a circuit breaker, the disconnectable type connection mode being used.
Figure 6:
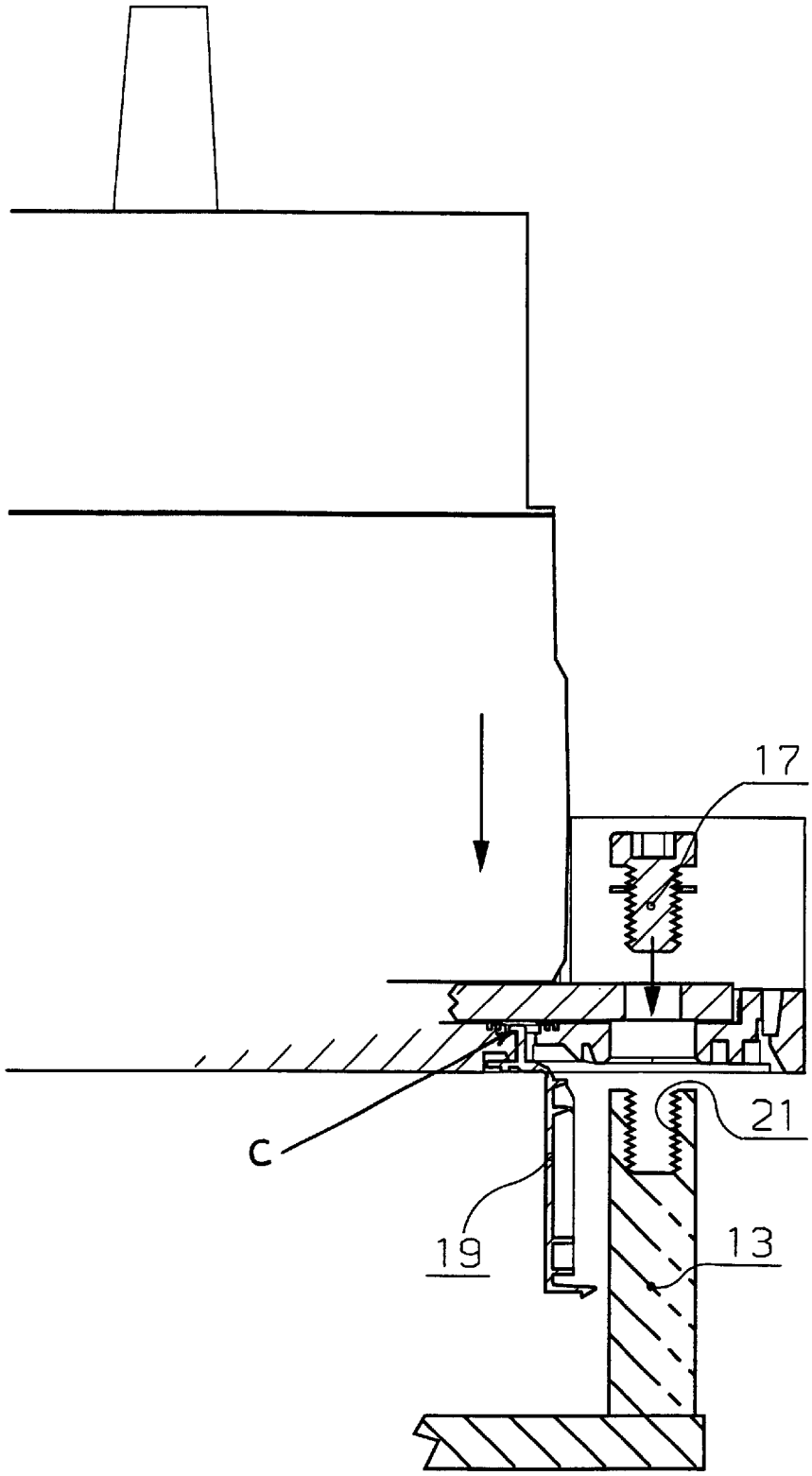
FIG. 6 is a partial longitudinal sectional view of FIG. 5.

In FIGS. 5 and 6, connection of the strips 3 is performed in a disconnectable mode. Thus, the openings 8 provided in the case 1 are designed to each receive the free end 13*a* of a fixed connecting prong 13, whose shape corresponds to that of the opening 8.

Each of the openings 8 provided in the case 1 is blanked off by an insulating cover 19 joined in an articulated manner to the case 1 by a hinge 14 integrated in an the cover 19. This hinge is fixed to the case by a clip C enabling the cover to remain secured to the case in the open position of the cover. It can also be noted that at the time closing takes place, the cover is closed by another clip.

The connection operation will be described briefly hereafter according to the type of connection chosen.

When connection is made via terminals 4, the covers 19 are moved to bolts or the open position (FIG. 2), then two screws with round heads 9, 10 are inserted in the corresponding opening 8. The screws are then screwed into the terminal 4 by means of a suitable tool, the screw heads rotating freely in the openings 8. The power cables 5 are then inserted in the orifices 22 provided for this purpose in the terminals 4 (FIG. 3).

When connection is performed on a bar 23, two bolts or screws with hexagonal heads 11, 12 are previously inserted via the rear of the apparatus D into the corresponding openings 8, 16 of the case 1 and of the strip 3 after the covers 19 have been opened. The bolt or screw heads 11, 12 being immobilized in the case 1, and fixing the bar 23 onto the strip 3 is achieved by a nut 15.

If the disconnectable type connection mode is chosen, the apparatus D is moved in the direction of fixed conductors in the form of prongs 13 so as to insert the ends 13*a* of the prongs 13 inside the openings 8 of the case 1. Fixing of the prongs 13 onto the strips 3 is achieved by a bolt or screw 17 inserted via the front of the apparatus D through the two orifices 16, 8 provided respectively in the strip 3 and the case 1 and screwed into the corresponding end 13*a* of the prongs 13. Each rigid conductor or prong 13 comprises an end 13*a* with two columns 18*a*, 18*b* of appreciably hexagonal cross section joined by a cross-member 20 and each having a fixing orifice 21 designed to receive the screw 17, said end 13*a* cooperating with a first opening 8 of corresponding shape of the case 1.

It can be noted that in the case where this connection mode is chosen, it is not absolutely necessary for the prong to be immobilized in rotation in the opening and therefore for the shape of the prong to correspond exactly to that of the opening.

Figure 7:
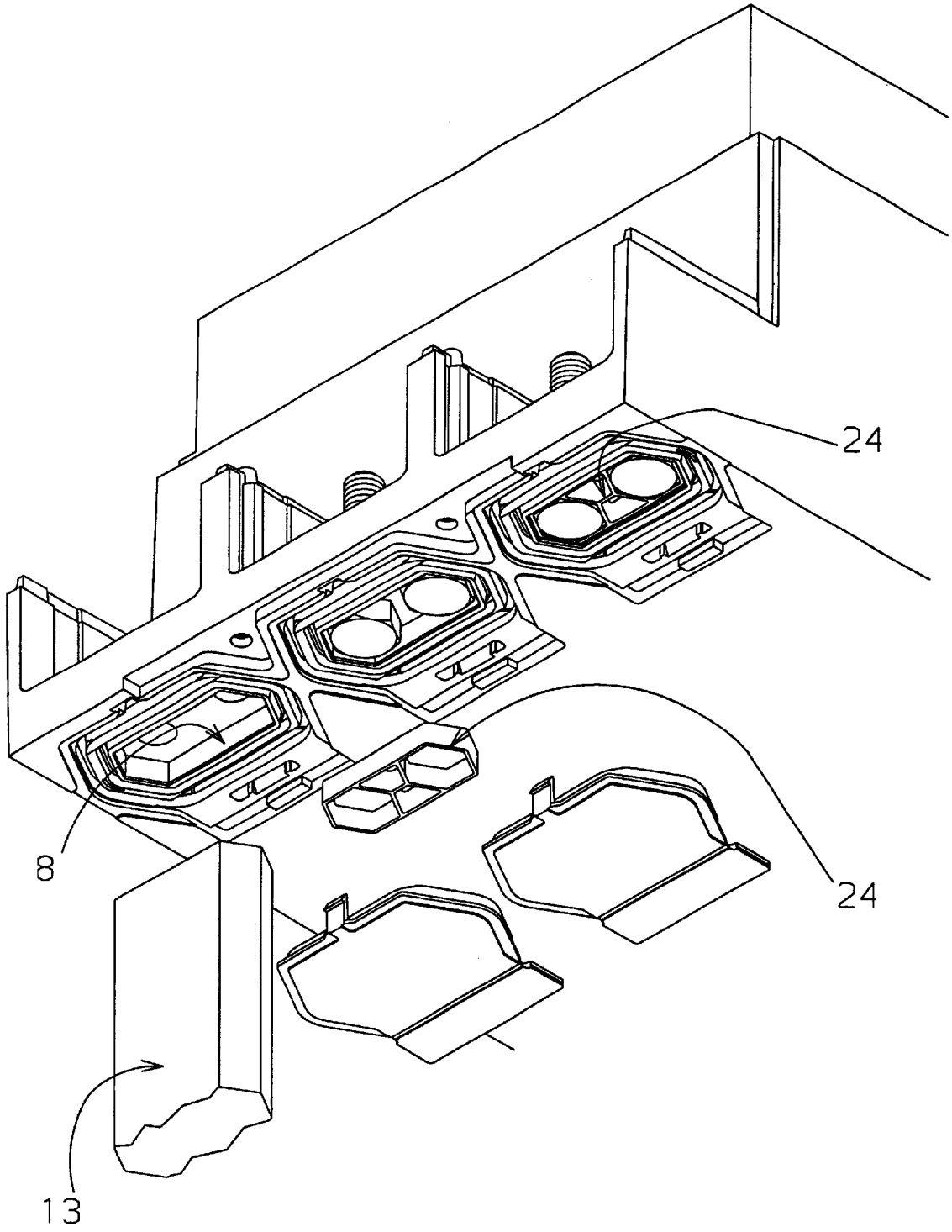
FIG. 7 is a partial perspective view, illustrating the rear part of a low voltage circuit breaker housed in a case according to another embodiment of the invention.

According to another particular embodiment of the invention, as seen in FIG. 7 this case includes in addition a strengthener 24 inserted in each first opening, which presents a slightly enlarged cross-section compared to the openings of the previous embodiment in order to improve the resistance of the case in holding the screws.

Advantageously, this strengthener 24 is removable so as to enable a fixed rigid conductor of slightly enlarged cross-section to be housed when it is extracted from the case.

It can be noted that the hexagonal shape of the housings and of the screw heads is given as an example only. Other shapes for the housings and screw heads will naturally be able to be envisaged within the scope of the invention provided that they enable these screws to be blocked in rotation and that they allow free rotation of circular-headed screws. The screws used will advantageously be standardized screws.

It can be seen that by means of the invention, switching from one connection mode to the other is performed with the same parts, without any intermediate part.

The different electrical isolation distances are ensured by the cover. Connection by bar is achieved in simple manner, a single tool being necessary to perform tightening. The possibility of replacing the standardized screws with others (more or less long) should also be noted.

The case of the apparatus fulfills several functions, i.e. supporting the connection strips, isolation of the phases from one another and from the outside, holding the bar connection screws in rotation, the function of cover of the fixing screws, holding the screws before and during installation of the apparatus, and respecting the electrical isolation distances by a cover.

It can also be noted that the screw cover is held captive due to the use of the integrated hinge.

What is claimed is:

1. A housing for an electrical apparatus, the housing comprising:

a connection strip; a case for housing the connection strip; an external conductor selected from the group consisting of bars and terminals; terminal compartments provided at one end of the case; and means for fixing the strip to the external conductor, said means comprising at least one bolt selected from the group consisting of circular and non-circular bolt heads, said means comprising a circular bolt head when said external conductor is a terminal and non-circular bolt head when said external conductor is a bar;

said strip fixing means comprising, for at least one of the compartments, a first opening provided in the case, the first opening being shared selectively to receive and guide in rotation a circular bolt head, and to prevent rotation of a non-circular bolt head with respect to the case, and a second opening provided in the connection strip and facing the first opening, and the bolt passing through said first and second openings to fix the conductor to the connection strip with the bolt head received in the first opening.

2. The housing according to claim 1, wherein the first opening includes a housing of a generally hexagonal shape for cooperating with a bolt having a head of the same shape.

3. The housing according to claim 1, wherein at least one of the first and second openings is closed by an insulating cover joined to the case by a hinge integrated in said cover and fixed to the case by a clip.

4. The housing according to claim 1, wherein the case partially comprises an insulating material for isolating different phases.

5. The housing according to claim 1, wherein the first opening is provided in the rear of the case.

6. The housing according to claim 1, wherein the first opening is designed to receive a fixed rigid conductor.

7. The housing according to claim 6, wherein the rigid conductor comprises an end including two columns each having an hexagonal cross section and joined by a cross-member, each of said columns comprising an orifice for fixing a bolt, wherein said end cooperates with the first opening of a corresponding shape in the case.

8. The housing according to claim 1, further comprising a strengthener inserted in the first opening and having a slightly larger cross section to improve the resistance of the case for holding the bolts.

9. The housing according to claim 8, wherein the strengthener is removable to enable a fixed rigid conductor of a slightly enlarged cross section to be housed when the strengthener is extracted from the case.

* * * * *